US011850485B2

(12) United States Patent
Jeoung

(10) Patent No.: US 11,850,485 B2
(45) Date of Patent: Dec. 26, 2023

(54) GOLF TEE HOLDER

(71) Applicant: MIRAE INDUSTRY CO., LTD., Jinju-si (KR)

(72) Inventor: Jae Hoon Jeoung, Jinju-si (KR)

( * ) Notice: Subject to any disclaimer, the term of this patent is extended or adjusted under 35 U.S.C. 154(b) by 202 days.

(21) Appl. No.: 17/627,733

(22) PCT Filed: Dec. 24, 2019

(86) PCT No.: PCT/KR2019/018430

§ 371 (c)(1),
(2) Date: Jan. 17, 2022

(87) PCT Pub. No.: WO2021/015373

PCT Pub. Date: Jan. 28, 2021

(65) Prior Publication Data

US 2022/0249927 A1 Aug. 11, 2022

(30) Foreign Application Priority Data

Jul. 22, 2019 (KR) ..... 10-2019-0088409

(51) Int. Cl.
*A63B 57/20* (2015.01)
*A63B 57/35* (2015.01)
*A63B 57/30* (2015.01)

(52) U.S. Cl.
CPC ..... *A63B 57/203* (2015.10); *A63B 57/207* (2015.10); *A63B 57/35* (2015.10); *A63B 57/353* (2015.10); *A63B 2209/08* (2013.01)

(58) Field of Classification Search
CPC ..... A63B 57/35; A63B 57/353; A63B 57/207; A63B 57/203; A63B 57/50; A63B 2209/08; Y10S 224/918
See application file for complete search history.

(56) References Cited

U.S. PATENT DOCUMENTS 6,220,973 B1 * 4/2001 Hsu ..... A63B 57/203 473/406
2002/0162866 A1 * 11/2002 Hurtgam ..... A45F 5/00 224/684

(Continued)

FOREIGN PATENT DOCUMENTS

JP 3096700 U 9/2003
KR 20-0347099 4/2004

(Continued)

OTHER PUBLICATIONS

English Specification of 10-1891062.

(Continued)

*Primary Examiner* — Corey N Skurdal
(74) *Attorney, Agent, or Firm* — ANTONIO HA & U.S. PATENT, LLC; Hong Jin Ha

(57) ABSTRACT

The present invention relates to a golf tee holder for inserting and carrying a golf tee and, more specifically, to a golf tee holder comprising a body part which is hollow, of which the upper part is open, and which has a fitting support port into which a golf tee is inserted and supported, on the inner side thereof, wherein there is a clip part, which is hung on golf clothes or belts for carrying, on the outer surface of one side of the body part, and a magnet part for attaching a combined marker/green repair tool on the outer surface of the other side of the body part, such that a golf tee is inserted inside the body part, the combined marker/green repair tool is attached to the magnet part, and the clip part is hung on pants (belt) of a golfer for carrying, thereby preventing the loss of golf tees, etc., and enabling same to be conveniently taken out and used during a round of golf so as to improve the convenience of a game of golf.

6 Claims, 8 Drawing Sheets

(56) References Cited

U.S. PATENT DOCUMENTS

| | | | | |
|---|---|---|---|---|
| 2004/0178095 | A1* | 9/2004 | Mora | A63B 57/203<br>206/315.9 |
| 2005/0103661 | A1 | 5/2005 | Dorner | |
| 2009/0209369 | A1 | 8/2009 | Smith et al. | |
| 2009/0209370 | A1 | 8/2009 | Smith et al. | |
| 2021/0121750 | A1* | 4/2021 | Krauter | A63B 57/20 |
| 2022/0233927 | A1* | 7/2022 | Galacz | A63B 57/50 |
| 2022/0409968 | A1* | 12/2022 | Goserud | A63B 57/207 |

FOREIGN PATENT DOCUMENTS

| | | |
|---|---|---|
| KR | 10-0538742 | 12/2005 |
| KR | 200410163 Y1 | 3/2006 |
| KR | 20-0433634 | 12/2006 |
| KR | 20-0442379 | 11/2008 |
| KR | 10-1891062 | 9/2018 |
| KR | 10-1965625 | 4/2019 |

OTHER PUBLICATIONS

English Specification of JP3096700U.
English Specification of 20-0442379.
English Specification of 20-0347099.
English Specification of 10-0538742.
English Specification of 10-1965625.
English Specification of KR200410163Y1.
English Specification of 20-0433634.

* cited by examiner (a)

(b)

(a)

(b)

GOLF TEE HOLDER

TECHNICAL FIELD

The present invention relates to a golf tee holder for carrying golf tees and, more specifically, to a golf tee holder that includes a body portion with hollow, open-top fitting supports for inserting and supporting golf tees on the inner surface thereof, wherein a clip portion is formed on the outer surface portion of the body portion to be fastened to golf clothes or belt, a magnet portion is formed on the rear outer surface portion of the body portion to attach a combination marker and green forker after inserting golf tees into the body portion and attaching the combination marker and green forker to the magnet portion, the golf tee holder may be hung to the golfer's pants (belt) with the clip portion and carried, thus rendering it possible to prevent loss of the golf tees and easily pull and use the golf tees and hence leading to enhanced convenience in playing golf.

BACKGROUND ART

In general, as items to play golf (also known as rounding), other various items than golf clubs and golf balls exist.

In other words, there are a wide variety of items necessary for playing golf, such as gloves, hats, golf shoes, tees, markers, green forks, range finders, pouches for storing the items, score sheets, and the like.

Among these items, a golf tee and a marker to mark the position of the ball on the green are must-have items.

In golf, a tee is an essential item for playing golf. The tee is placed into the ground at a predetermined height for the tee shot. A golf ball is placed on the tee for a stroke using a golf club.

Golfers place a tee in the ground in the tee box of each hole while playing game. To that end, golfers store tees in a separate pouch or the pocket and pull out and use the tees while the game proceeds.

As such, tees are pulled out and used in every tee shot hole, Thus, it is required to store and pull out tees.

Storing tees in the pocket and taking it out every time it is used may result in inconvenience and the risk of loss.

Further, due to their usage, dirt or other foreign substances may remain on golf tees after use and, if used golf tees are put and stored in the pocket or pouch as they are, insanitary conditions occur.

Further, when stored in a portable pouch, golf tees may be mixed with other items in the pouch, Thus, golfers have the hassle of finding an appropriate golf tee each time in playing game.

Meanwhile, a ball marker is used to mark the position of the golf ball on the green while playing golf not to disturb other players and is another essential item in golf game.

The ball marker is not used until before the ball is landed on the green. Thus, the player carries the ball maker in the pocket or a pouch while moving on the field.

Carrying a ball marker together with or separately from golf tees is an obstacle to the play requiring that they be quickly used, and while delving into the pocket, the player may be distracted.

Conventionally, there has been used a separate holder with a magnet for attaching a ball maker. The ball marker holder is mounted on a hat, buckle, glove, or golf shoe and was removed and used whenever needed.

However, such a conventional ball marker holder is carried separately from golf tees and is still inconvenient in use while playing golf. Therefore, a need exists for a new type of golf tee holder products that may store and carry a ball maker and golf tees together.

PRIOR TECHNICAL DOCUMENTS

Patent Documents (Patent Document 1) KR 10-0538742 registered on Dec. 19, 2005

(Patent Document 2) KR 10-1965625 registered on Mar. 29, 2019

(Patent Document 3) KR 20-0410163 registered on Feb. 24, 2006

DETAILED DESCRIPTION THE INVENTION

Technical Problems

The present invention has been conceived to address the foregoing problems.

The present invention aims to provide a golf tee holder that includes a hollow, open-top body portion with fitting supports for insertion and support of golf tees and a clip portion formed on the front outer surface portion of the body portion and fastened to golf clothes or a belt to be hung to the golfer's pants (belt) to carry, thereby allowing for quick pullout and use of a golf tee while playing golf and preventing loss of golf tees and hence enhancing convenience in a golf game.

Another object of the present invention is to allow for convenience pullout and use of golf tees and quick progress of a golf game by providing a magnet portion for attaching a combination marker and green forker on the outer surface portion of the body portion to allow the combination marker and green forker to be carried along with golf tees.

Another object of the present invention is to provide a golf tee holder that allows for easier pullout and insertion of golf tees without extra care and may easily wash dirt or foreign substances out of golf tees.

Another object of the present invention is to allow a golf game to be efficiently played while preventing loss by carrying a combination marker and green forker and golf tees together.

Means to Address the Problems

To achieve the above objects, according to the present invention, a golf tee holder comprises a hollow body portion 110 with closed side surfaces and a top opening and a bottom opening and including a plurality of fitting supports 111 each formed for insertion and support of a golf tee 101 on an inner surface thereof; a clip portion 120 provided on an outer surface portion on a first side of the body portion 110 and hooked to golf clothes or a belt; and a magnet portion 130 provided on an outer surface portion of an second side of the body portion 110 to face the clip portion 120 and attaching a combination marker and green forker 102, wherein each of the plurality of fitting supports 111 includes a hollow truncated cone 111*a* along in a lower direction inside the body portion 110 and elastic supports 111*b* formed between a plurality of slot grooves 111*c* to allow a lower end of the golf tee 101 to be elastically inserted through an end of the truncated cone 111*a* and supported so that the golf tee 101 is elastically inserted and fixed by the elastic supports 111*b*.

A border wall 112 is formed higher than base portions of the fitting supports 111 between the fitting supports 111, and a guide inclined surface portion 113 is formed on the border wall 112 to have two opposite rounded sides and to be inclined to gradually increase in thickness from an upper side of an inner wall of the body portion 110 to an upper side of the border wall 112.

Further, according to the present invention, the upper side of the body portion 110 gradually decreases in height from an upper end of a front surface portion A, where the clip portion 120 is provided, to a rear surface portion B, where the magnet portion 130 is provided, to expose an inside of the body portion 110.

Further, according to the present invention, guard portions 115 project on two opposite edges of the rear surface portion B of the body portion 110 having the magnet portion 130, preventing the combination marker and green forker 102 mounted on the magnet portion 130 from arbitrarily escaping off by external force.

Further, according to the present invention, elastic bands 111*d* are provided in the slot grooves 111*c* provided in the truncated cone 111*a* to elastically connect the elastic supports 111*b*.

Further, according to the present invention, a short tee fitting portion 140 is inserted into the bottom opening of the body portion 110 for insertion and fixation of a short tee. The short tee fitting portion 140 includes a fitting fixing portion 141 having a top opening and an internal space, a supporting jaw 142 projecting outward from a lower end of the fitting fixing portion 141 to support a bottom surface of the body portion 110, and a tee fitting hole 143 provided in a center of a lower surface of the fitting fixing portion 141 to communicate with an inside thereof to allow the short tee 101*a* to be inserted therethrough, A cylindrical tee support 144 is provided inside the fitting fixing portion 141 to communicate with the tee fitting hole 143 for insertion and support of a body of the short tee 101*a* inserted through the tee fitting hole 143.

Further, according to the present invention, the tee support 144 decreases in diameter form its base to tip and is formed with a plurality of slots 144*a* in the length direction thereof along the circumference to have elastic restoration force.

Effects of the Invention

According to the present invention, a golf tee holder includes a hollow, open-top body portion with fitting supports for insertion and support of golf tees and a clip portion formed on the front outer surface portion of the body portion and fastened to golf clothes or a belt to be hung to the golfer's pants (belt) to carry, thereby allowing for quick pullout and use of a golf tee while playing golf and preventing loss of golf tees and hence enhancing convenience in a golf game.

Further, according to the present invention, it is possible to allow for convenience pullout and use of golf tees and quick progress of a golf game by providing a magnet portion for attaching a combination marker and green forker on the outer surface portion of the body portion to allow the combination marker and green forker to be carried along with golf tees.

Further, according to the present invention, it is possible to provide a golf tee holder that allows for easier pullout and insertion of golf tees without extra care and may easily wash dirt or foreign substances out of golf tees.

Further, according to the present invention, it is possible to allow a golf game to be efficiently played while preventing loss by carrying a combination marker and green forker and golf tees together.

BEST MODE TO PRACTICE THE INVENTION

Figure 1:
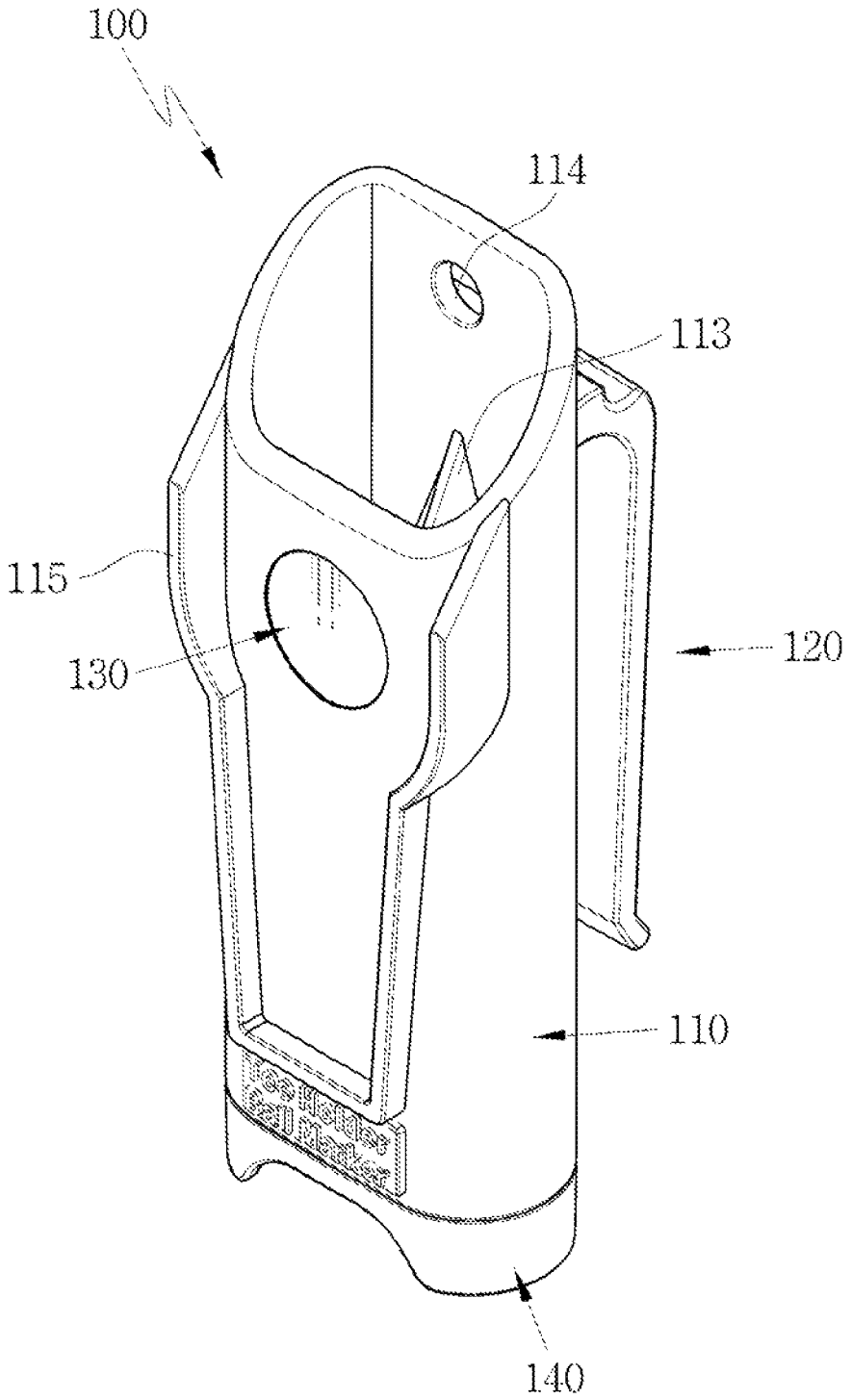
FIG. 1 is a perspective view illustrating a golf tee holder according to the present invention.

Hereinafter, preferred embodiments of the present invention are described with reference to the accompanying drawings to be easily practiced by one of ordinary skill in the art.

As shown in FIGS. 1 to 7, according to the present invention, a golf tee holder 100 includes, a hollow body portion 110 with closed side surfaces and a top opening and a bottom opening and including a plurality of fitting supports 111 each formed for insertion and support of a golf tee 101 on an inner surface thereof.

A clip portion 120 is provided on an outer surface portion on a first side of the body portion 110 and hooked to golf clothes or a belt.

A magnet portion 130 is provided on an outer surface portion of an second side of the body portion 110 to face the clip portion 120 and attaching a combination marker and green forker 102.

The fitting support 111 includes, a hollow truncated cone 111*a* along in a lower direction inside the body portion 110 and elastic supports 111*b* formed between a plurality of slot grooves 111*c* to allow a lower end of the golf tee 101 to be elastically inserted through an end of the truncated cone 111*a* and supported so that the golf tee 101 is elastically inserted and fixed by the elastic supports 111*b* to be carried.

In golf, a golf tee is an essential item for playing golf. The tee is placed into the ground at a predetermined height for the tee shot. A golf ball is placed on the tee for a stroke (shot) with a golf club.

Golfers place a tee into the ground in a tee box at each hole during play. To that end, golfers put and store tees in a separate pouch or their pocket and pull out one while playing game.

To reduce the inconvenience of putting the golf tee 101 in a separate pouch or pocket and pulling out it for use, the golf tee holder 100 according to the present invention is hung to the golfer's belt so that the golf tee may rapidly be pulled out of the golf tee holder 100 when needed, thereby increasing convenience and allowing the golf game to be rapidly played.

Preferably, there are provided two or more fitting supports 111 to store a long tee and a short tee. Generally, golf tees 101 include longer tees, which are placed at a higher distance from the ground in the tee box, shorter tees, which are placed at a lower distance, and intermediate tees.

In a configuration in which two or more fitting supports 111 are formed, a border wall 112 which is formed to be higher than the base portions of the fitting supports 111, is provided between the fitting supports 111. A guide inclined surface portion 113 is rounded to allow the golf tees 101 to be easily guided and inserted into the fitting supports 111 on two opposite sides of the upper portion of the border wall 112 and is inclinedly formed to gradually thicken from the upper side of the inner wall surface of the body portion 110 to the upper side of the border wall 112.

Therefore, when the golf tee 101 is inserted into the fitting support 111, its lower portion touches and slides on the guide inclined surface portion 113 and is thus guided and easily inserted into the fitting support 111. Thus, lots of convenience is achieved.

Here, the base portion of the fitting support 111 refers to a portion where the fitting support 111 is connected to the inner all portion of the body portion 110.

Further, the rear outer surface portion is lower than the front outer surface portion so that the golf tee passes the rear outer surface portion and is stuck to the front outer surface portion. Thus, the golf tee may easily be inserted toward the lower portion.

If the golf tee 101 is inserted into the fitting support 111 as provided as described above, the moment that an end of the golf tee 101 is inserted into the fitting support 111, the elastic support 111*b* is elastically open to elastically support the end of the golf tee 101.

In this case, although contacting the guide inclined surface portion 113, the end of the golf tee 101 may be slid and guided along the inclined surface of the guide inclined surface portion 113 and thus be easily inserted into the elastic support 111*b*.

Due to the relative height difference between the rear outer surface portion and the front outer surface portion, the golfer may sensibly put the golf tee into the fitting support 111 even without looking at the fitting support 111 in the golf tee holder of the present invention which is worn mainly on his hip.

Further, since the lower portion of the fitting support 111 of the present invention is open, foreign substances, such as dirt on the golf tee, fall down while playing game, a separate washing process is not required.

Figure 2:
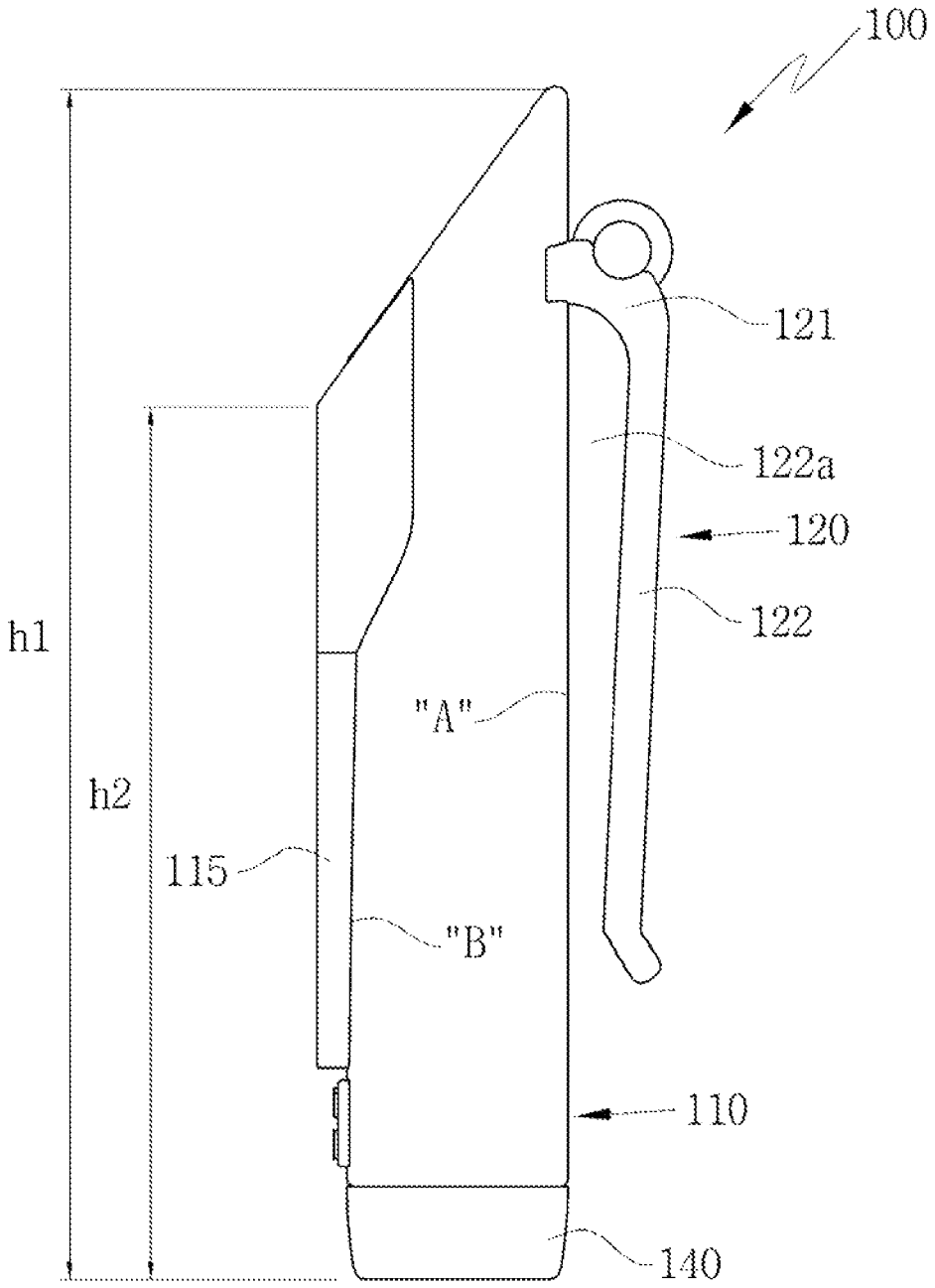
FIG. 2 is a side view illustrating a golf tee holder according to the present invention.

This is described in greater detail. As shown in FIG. 2, the upper portion of the body portion 110 is open, and the edge of the open portion decreases in height from the upper end of the front surface portion A, where the clip portion A 120 is formed, to the upper end of the rear surface portion B, where the magnet portion 130 is formed. The height is a height from the horizontal bottom surface of the body portion 110. In other words, the height h1 of the upper end of the front surface portion A of the body portion 110 is larger than the height h2 of the upper end of the rear surface portion B of the body portion 110.

Accordingly, when the golf tee is inserted and supported in the body portion 110, the golf tee is exposed at the upper portion of the rear surface portion of the body portion 110 so that the golf tee may easily be pulled out or put in through the exposed portion.

Figure 8:
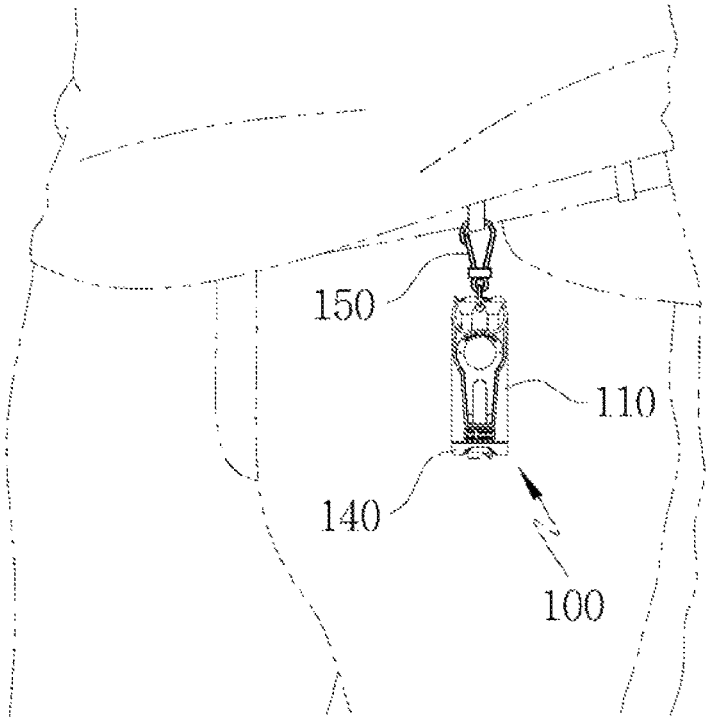
FIG. 8 is a view schematically illustrating a state in which a golf tee holder is worn on a golfer's belt and belt ring, with a golf tee and a combination marker and green forker received in the golf tee holder.
Figure 8:
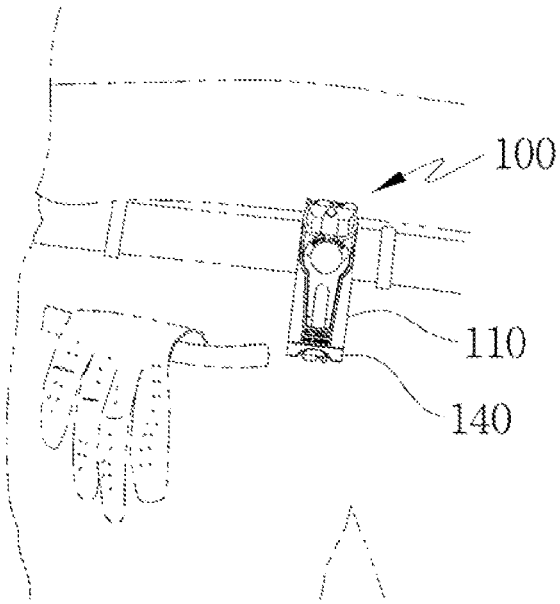

Further, an installation hole 114 for a ring 150 for hanging to a belt loop is provided in an upper portion of the front surface portion of the body portion 110 as shown in FIG. 8(*a*).

According to the present invention, the ring 150 is connected through the installation hole 114 and is hung to the belt loop of the golf pants so that the golf tee holder 100 is easy to carry.

The installation hole 114 for the ring 150 may also be provided in an upper end of the clip portion 120.

Guard portions 115 project on two opposite edges of the rear surface portion B of the body portion 110 having the magnet portion 130, preventing the combination marker and green forker 102 mounted on the magnet portion 130 from arbitrarily escaping off by external force.

The upper portions of the guard portions 115, where the marker portion 102*a* is positioned, are broadened while the lower portions thereof, where the green forker portion 102*b* is positioned, are narrowed.

Basically, the combination marker and green forker 102 is shaped as a think circular plate and is formed of a combination of a marker, which is placed on the green to lift the ball and mark the position, and a green fork for fixing the ball mark. Further, the marker portion 102*a* of the present invention is formed of a metal to be easily attached to the magnet portion 130.

A short tee fitting portion 140 may be inserted into the lower opening of the body portion 110 to insert and fasten a short tee.

In a golf game, short tees are golf items used to be placed at the lowest distance from the ground in par-3 holes for iron tee shots.

The short tee fitting portion 140 includes a fitting fixing portion 141 having an upper opening and an internal space and inserted into the lower opening of the body portion 110, a supporting jaw 142 projecting outward from the lowerend of the fitting fixing portion 141 to support the bottom surface of the body portion 110, and a tee fitting hole 143 formed in a center of lower surface of the fitting fixing portion 141 and communicating with the inside to allow the short tee 101*a* to be inserted therethrough.

Inside the fitting fixing portion 141 is provided a cylindrical tee support 144 communicating with the tee fitting hole 143 and supporting the body of the short tee 101*a* inserted through the tee fitting hole 143.

Further, the tee support 144 decreases in diameter form its base to tip and is formed with a plurality of slots 144*a* in the length direction thereof along the circumference to have elastic restoration force.

Therefore, if the short tee 101*a* is inserted through the tee fitting hole 143 from under the short tee fitting portion 140, its head is stuck and supported by the tee fitting hole 143 while the body is elastically inserted and supported by the tee support 144.

Further, the supporting jaw 142 provided in the short tee fitting portion 140 includes skirt portions 142*a* that are bent downward and recesses 142*b* formed on two opposite sides of the skirt portions 142*a* to easily pull out the short tee 101 with the thumb and index finger.

Thus, the short tee may easily be inserted or pulled out through the recesses formed in the skirt portions 142*a* formed at the lower portion of the short tee fitting portion 140.

Through holes 145 are formed, in the lower surface of the short tee fitting portion 140, on two opposite sides of the tee fitting hole 143.

As the through holes 145 communicate with the inside of the body portion 110, foreign substances, such as dirt, on the golf tee and present in the body portion 110 may fall outside during play.

Meanwhile, the golf tee holder 100 has the clip portion 120 on the front surface portion A of the body portion 110 to be fastened to the belt to allow the golf tee holder to tightly contact the golfer's body.

The clip portion 120 includes a connection portion 121 connected to the front surface portion of the body portion 110, at an upper side thereof, and a supporting surface portion 122 bent downward from an end of the connection portion 121. The supporting surface portion 122 is spaced apart by a predetermined interval from the front surface portion of the body portion 110, from the connection portion 121 to its lower end, for allowing insertion of a belt.

Preferably, an end of the supporting surface portion 122 is formed to be elastically brought in contact with the outer surface of the body portion 110. When a belt is worn through the interval 122*a*, the end of the supporting surface portion 122 is elastically open and the belt is inserted. Then, the end elastically comes back in tight contact with the outer surface of the body portion 110. Thus, it is possible to prevent arbitrary removal and loss of the golf tee holder.

Figure 3:
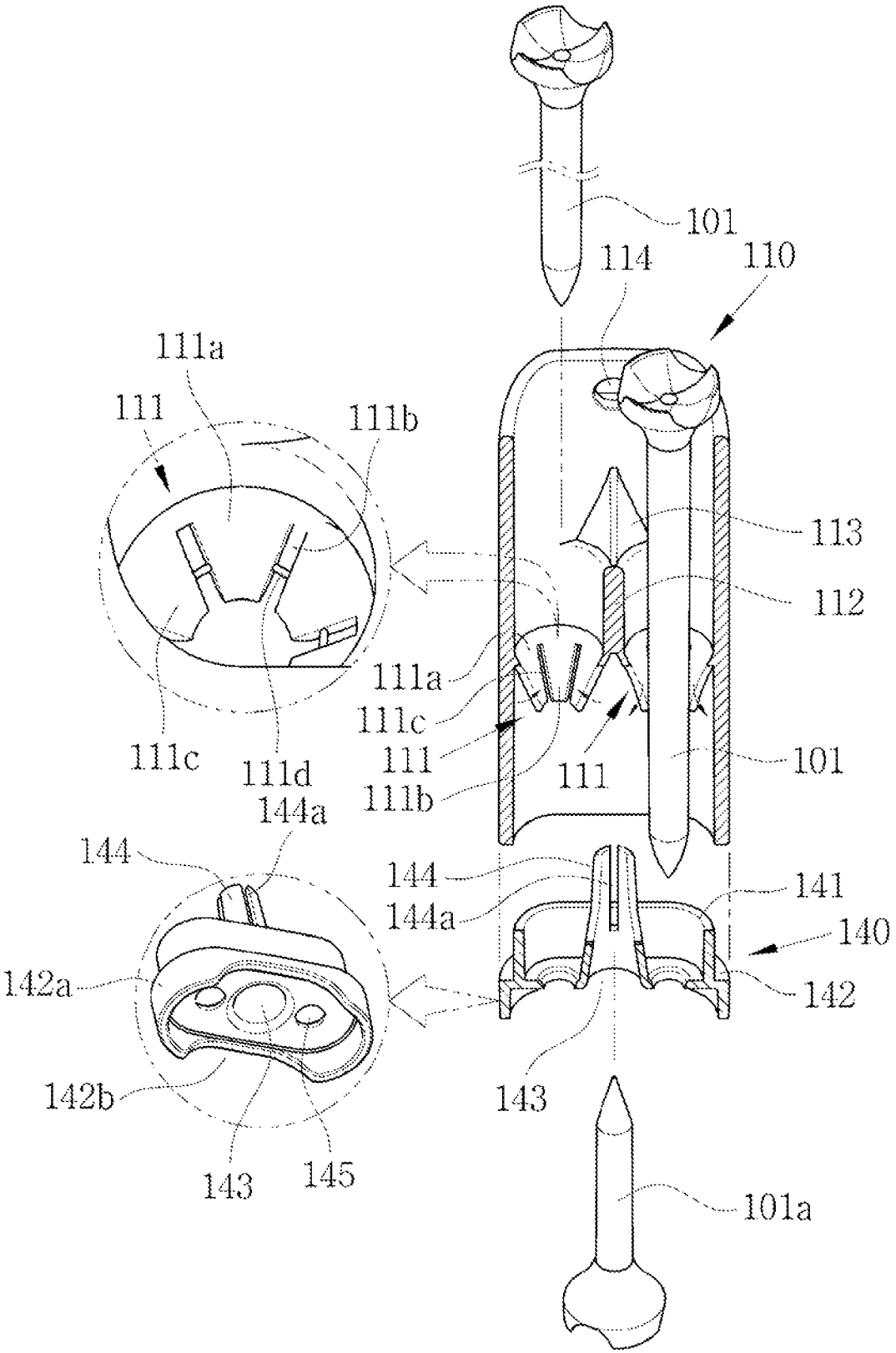
FIG. 3 is a cross-sectional view illustrating a golf tee holder according to the present invention.
Figure 4:
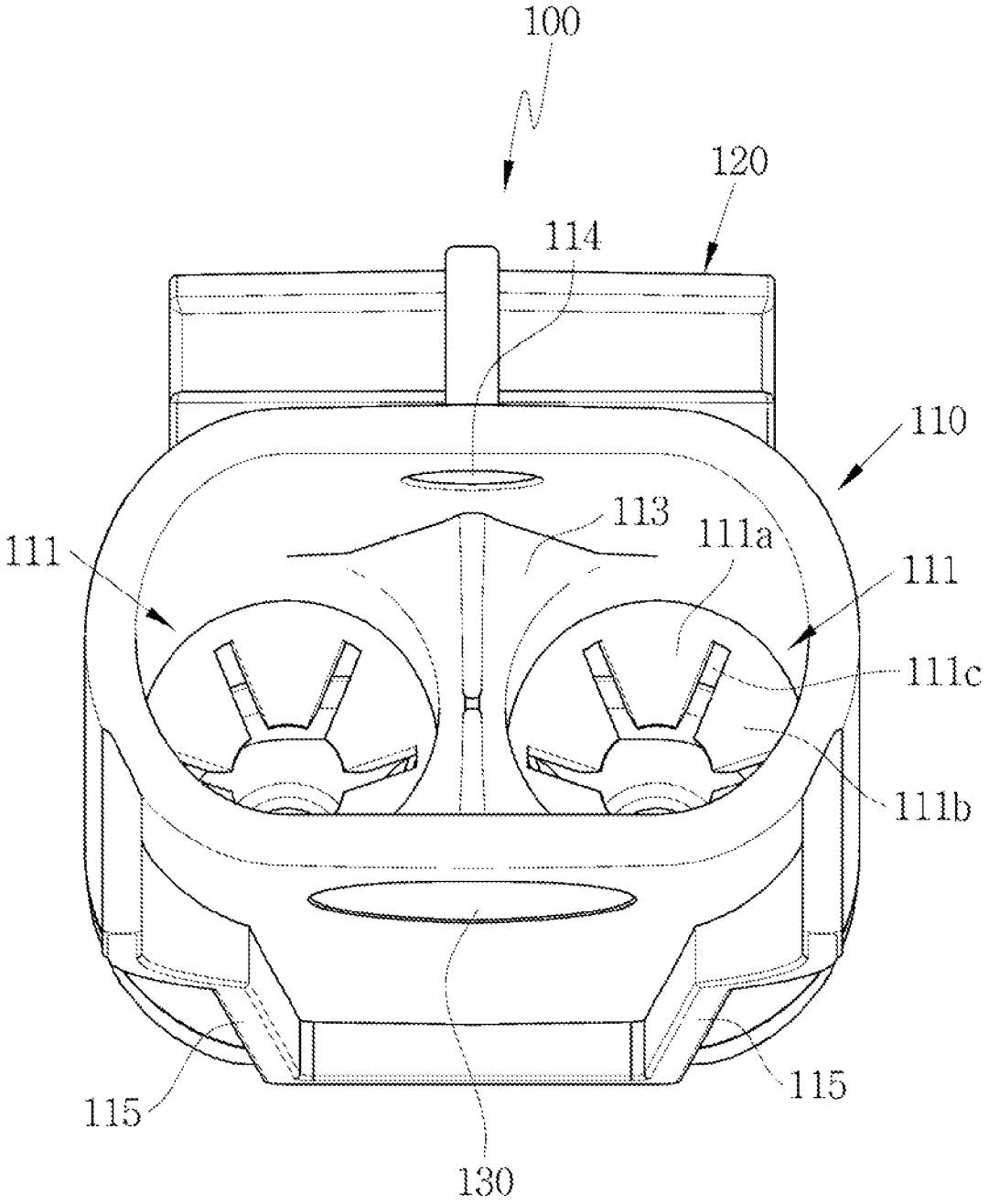
FIG. 4 is a plan view illustrating a golf tee holder according to the present invention.
Figure 5:
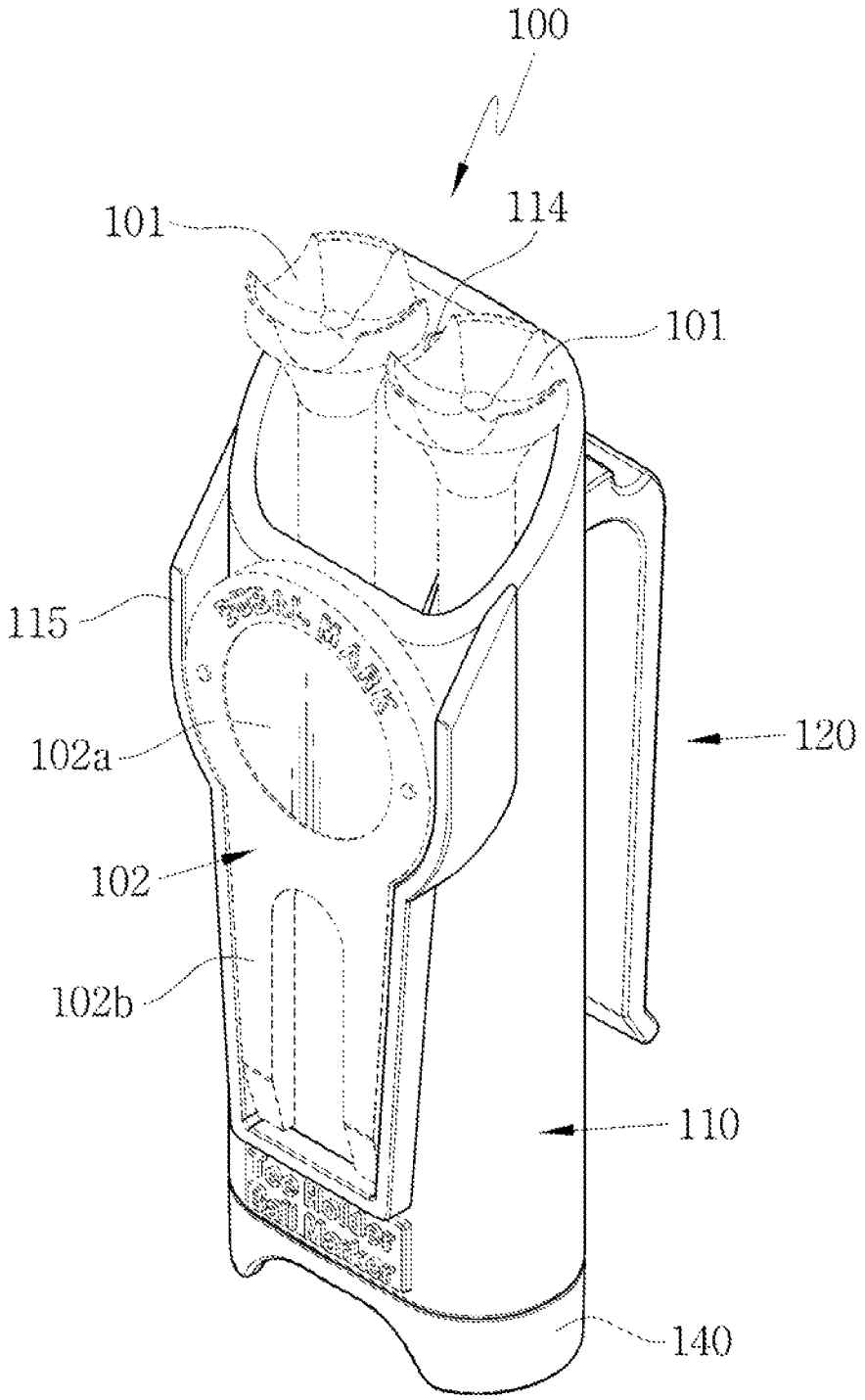
FIG. 5 is a perspective view illustrating a state in which a golf tee and a combination marker and green forker are received in a golf tee holder according to the present invention.
Figure 6:
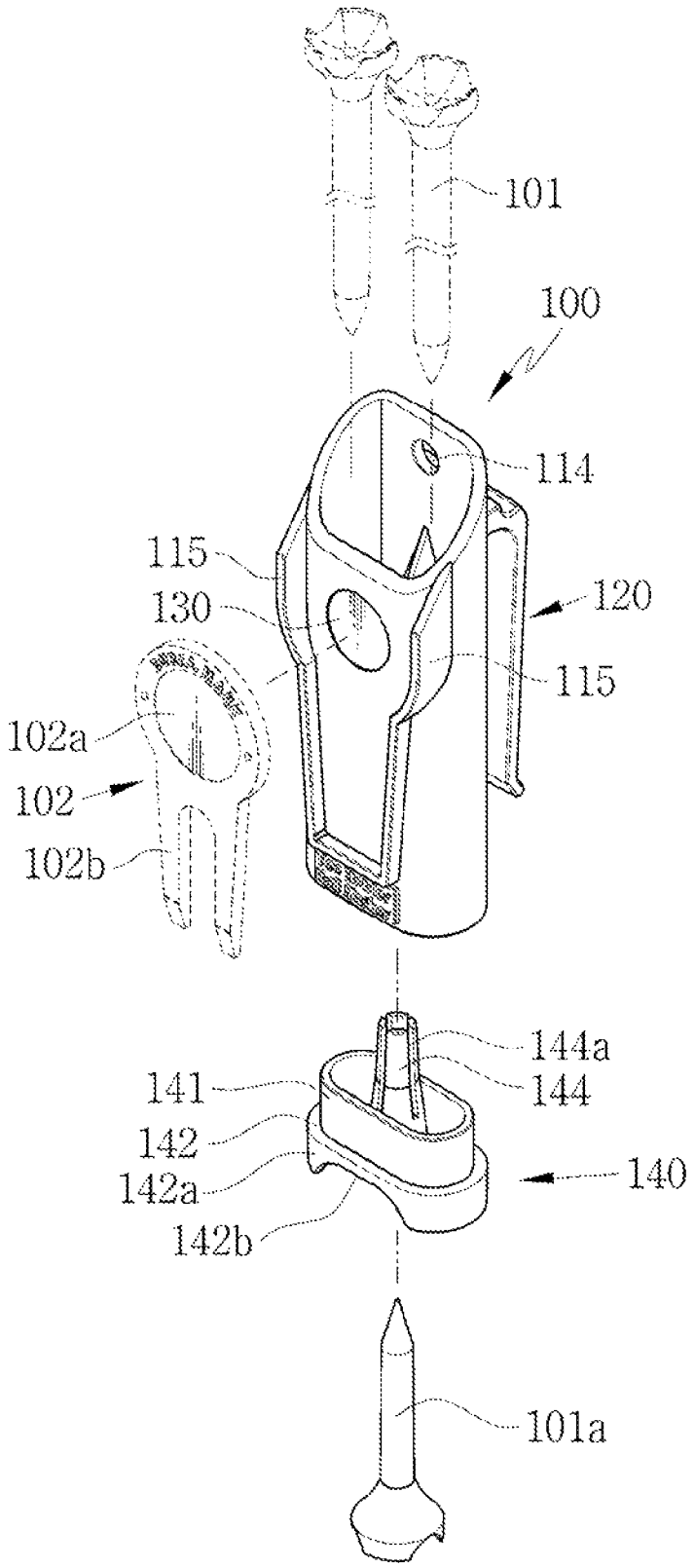
FIG. 6 is an exploded perspective view illustrating a state in which a golf tee and a marker-cum-green forker are separated in a golf tee holder according to the present invention.

According to the present invention, elastic bands 111*d* may be further provided in the slot grooves 111*c* formed between the elastic supports 111*b* of the truncated cone 111*a* to elastically connect the elastic supports 111*b* as shown in FIG. 3.

If the elasticity of the elastic supports 111*b* decreases, insertion of the golf tee 101 into the fitting support 111 may loosen, causing inconvenience. To prevent this, the elastic supports 111*b* are elastically connected together to maintain the elastic force of the elastic supports 111*b* for a long time. Thus, further increased durability is attained.

Figure 7:
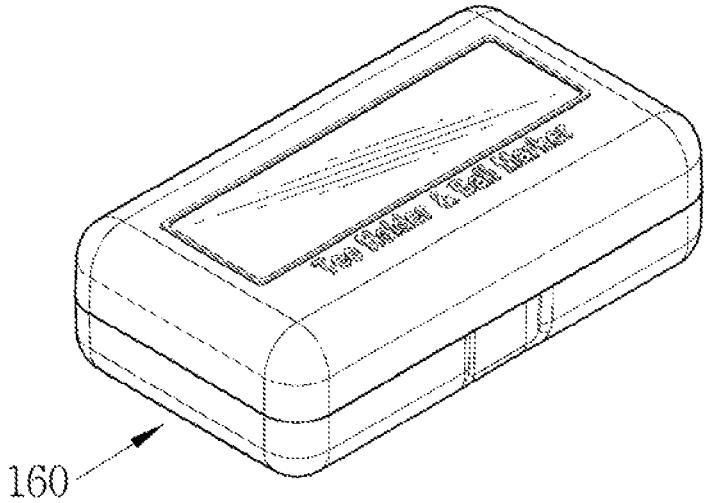
FIG. 7 is a perspective view illustrating a state in which a golf tee holder is received in a separate storage case.
Figure 7:
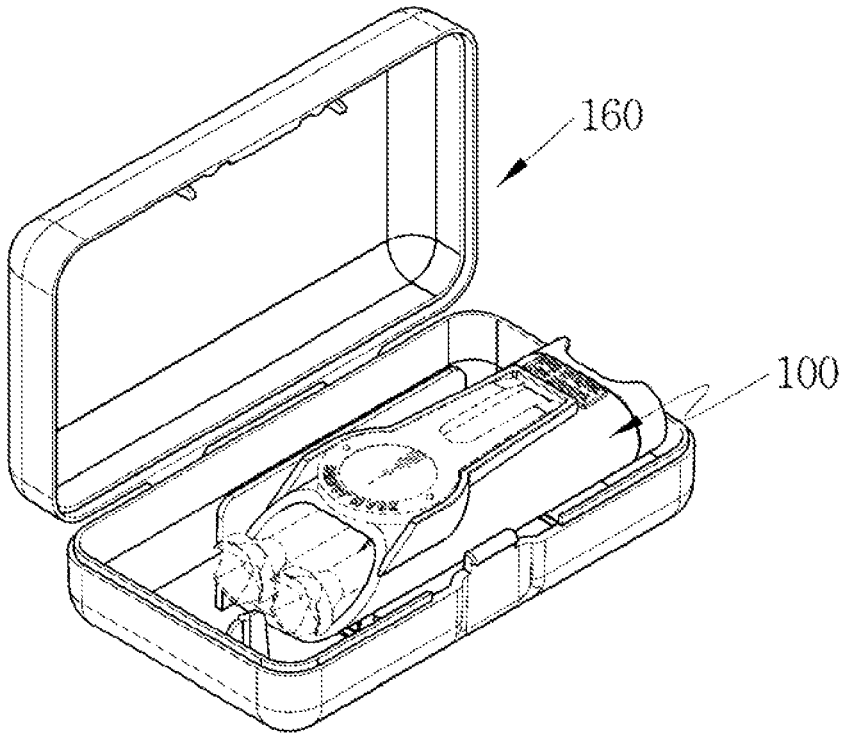

Meanwhile, the golf tee holder of the present invention may be stored in a separate storage case 160 for more efficient management after play, as shown in FIG. 7.

As described above, the golf tee holder according to the present invention may carry a ball combination marker and green forker as well as golf tees, which are essential items for playing golf, allowing for more convenient golf play.

As set forth above, according to the present invention, a golf tee holder includes a body portion with hollow, open-top fitting supports for inserting and supporting golf tees on the inner surface thereof. A clip portion is formed on the outer surface portion of the body portion to be fastened to golf clothes or belt. A magnet portion is formed on the rear outer surface portion of the body portion to attach a combination marker and green forker After inserting golf tees into the body portion and attaching the combination marker and green forker to the magnet portion, the golf tee holder may be hung to the golfer's pants (belt) with the clip portion and carried. Thus, it is possible to prevent loss of the golf tees and easily pull and use the golf tees, thereby leading to enhanced convenience in playing golf.

The invention claimed is:

1. A golf tee holder, comprising:

a hollow body portion (110) with closed side surfaces and a top opening and a bottom opening and including a plurality of fitting supports (111) each formed for insertion and support of a golf tee (101) on an inner surface thereof;

a clip portion (120) provided on an outer surface portion on a first side of the body portion (110) and hooked to golf clothes or a belt; and a magnet portion (130) provided on an outer surface portion of a second side of the body portion (110) to face the clip portion (120) and attaching a combination marker and green forker (102), wherein each of the plurality of fitting supports (111) includes a hollow truncated cone (111*a*) along in a lower direction inside the body portion (110) and elastic supports (111*b*) formed between a plurality of slot grooves (111*c*) to allow a lower end of the golf tee (101) to be elastically inserted through an end of the truncated cone (111*a*) and supported so that the golf tee (101) is elastically inserted and fixed by the elastic supports (111*b*), wherein a border wall (112) is formed higher than base portions of the fitting supports (111) between the fitting supports (111), and wherein a guide inclined surface portion (113) is formed on the border wall (112) to have two opposite rounded sides and to be inclined to gradually increase in thickness from an upper side of an inner wall of the body portion (110) to an upper side of the border wall (112).

2. The golf tee holder of claim 1, wherein the upper side of the body portion (110) gradually decreases in height from an upper end of a front surface portion (A), where the clip portion (120) is provided, to a rear surface portion (B), where the magnet portion (130) is provided, to expose an inside of the body portion (110).

3. The golf tee holder of claim 2, where guard portions (115) are provided to project on two opposite edges of the rear surface portion B of the body portion (110) having the magnet portion (130) to prevent the combination marker and green forker (102) mounted on the magnet portion (130) from arbitrarily escaping off by external force.

4. The golf tee holder of claim 1, wherein elastic bands (111*d*) are provided in the slot grooves (111*c*) provided in the truncated cone (111*a*) to elastically connect the elastic supports (111*b*).

5. The golf tee holder of claim 1, wherein a short tee fitting portion (140) is inserted into the bottom opening of the body portion (110) for insertion and fixation of a short tee, wherein the short tee fitting portion (140) includes a fitting fixing portion (141) having a top opening and an internal space, a supporting jaw (142) projecting outward from a lower end of the fitting fixing portion (141) to support a bottom surface of the body portion (110), and a tee fitting hole (143) provided in a center of a lower surface of the fitting fixing portion (141) to communicate with an inside thereof to allow the short tee (101*a*) to be inserted therethrough, and wherein a cylindrical tee support (144) is provided inside the fitting fixing portion (141) to communicate with the tee fitting hole (143) for insertion and support of a body of the short tee (101*a*) inserted through the tee fitting hole (143).

6. The golf tee holder of claim 5, wherein the tee support (144) decreases in diameter form a base thereof to a tip thereof and is formed with a plurality of slots (144*a*) in a length direction thereof along a circumference thereof to have elastic restoration force.

* * * * *